US012123278B2

(12) United States Patent
Carragher et al.

(10) Patent No.: US 12,123,278 B2
(45) Date of Patent: Oct. 22, 2024

(54) PLUG WITH COMPOSITE ENDS AND METHOD OF FORMING AND USING

(71) Applicant: BISN TEC LTD., Warrington (GB)

(72) Inventors: Paul Carragher, Cheshire (GB); Andre Levchenko, Houston, TX (US); Billy Clark, Katy, TX (US); Lance Underwood, Cypress, TX (US)

(73) Assignee: BiSN Tec Ltd., Warrington (GB)

( * ) Notice: Subject to any disclaimer, the term of this patent is extended or adjusted under 35 U.S.C. 154(b) by 0 days.

(21) Appl. No.: 18/011,576

(22) PCT Filed: Jun. 22, 2021

(86) PCT No.: PCT/IB2021/000504

§ 371 (c)(1),
(2) Date: Dec. 20, 2022

(87) PCT Pub. No.: WO2021/260442

PCT Pub. Date: Dec. 30, 2021

(65) Prior Publication Data

US 2023/0287756 A1 Sep. 14, 2023

Related U.S. Application Data

(60) Provisional application No. 63/042,284, filed on Jun. 22, 2020.

(51) Int. Cl.

| | |
|---|---|
| ***E21B 33/12*** | (2006.01) |
| ***E21B 33/134*** | (2006.01) |
| ***E21B 36/00*** | (2006.01) |

(52) U.S. Cl.
CPC ..... *E21B 33/1212* (2013.01); *E21B 33/134* (2013.01); *E21B 36/008* (2013.01)

(58) Field of Classification Search
CPC ..... E21B 33/134; E21B 33/13; E21B 36/008; E21B 33/1208; E21B 33/12; E21B 36/00; E21B 33/1212; E21B 33/1204; E21B 33/124; E21B 36/04; E21B 36/003
See application file for complete search history.

(56) References Cited

U.S. PATENT DOCUMENTS

| | | | | |
|---|---|---|---|---|
| 10,309,187 | B2 | 6/2019 | Carragher | |
| 2003/0132224 | A1* | 7/2003 | Spencer | E21B 33/13 166/60 |
| 2018/0094504 | A1* | 4/2018 | Hearn | A01H 5/10 |
| 2018/0266202 | A1 | 9/2018 | Pray | |
| 2020/0011150 | A1 | 1/2020 | Carragher | |
| 2020/0165894 | A1 | 5/2020 | Shafer | |

FOREIGN PATENT DOCUMENTS

| | | | | |
|---|---|---|---|---|
| CA | 3119702 | A1 * | 5/2019 | E21B 29/10 |
| CA | 3126183 | A1 * | 7/2020 | C09K 8/426 |

* cited by examiner

*Primary Examiner* — Zakiya W Bates

(57) ABSTRACT

A plug with composite reinforced end(s) and a mostly-bismuth-alloy middle section. At least one end comprises a composite material. One end is a composite, with a bismuth alloy and a particulate material of greater strength than the bismuth material. A plug having both ends of the composite material.

14 Claims, 3 Drawing Sheets

PLUG WITH COMPOSITE ENDS AND METHOD OF FORMING AND USING

BACKGROUND OF THE INVENTION

Field of the Invention

Embodiments of the present invention relates generally to apparatus and methods for plugging abandoning and working over oil and gas wells.

Plugs made from low-melting-point alloys (LMPAs) have been disclosed in numerous prior art documents. Plugs are created by melting the alloy in the wellbore, either with electric heater or chemical heat means; the alloy then re-solidifies in the wellbore. Due to its high bismuth content, the expands upon solidification, this expansion creating sufficient radial force between the alloy and the wellbore to create a seal and thus form a plug.

Generally, the term "about" and the symbol "~" as used herein, unless specified otherwise, is meant to encompass a variance or range of ±10%, the experimental or instrument error associated with obtaining the stated value, and preferably the larger of these.

As used herein, unless stated otherwise, room temperature is 25° C. And, standard ambient temperature and pressure is 25° C. and 1 atmosphere. Unless expressly stated otherwise all tests, test results, physical properties, and values that are temperature dependent, pressure dependent, or both, are provided at standard ambient temperature and pressure, this would include viscosities.

As used herein unless specified otherwise, the recitation of ranges of values herein is merely intended to serve as a shorthand method of referring individually to each separate value falling within the range. Unless otherwise indicated herein, each individual value within a range is incorporated into the specification as if it were individually recited herein.

This Background of the Invention section is intended to introduce various aspects of the art, which may be associated with embodiments of the present inventions. Thus, the forgoing discussion in this section provides a framework for better understanding the present inventions, and is not to be viewed as an admission of prior art.

SUMMARY

Thus, there has been a long standing and unfulfilled need for further improved methods and tools for performing downhole operations, such as plugging, abandonment and workovers. The present inventions, among other things, solve these needs by providing the articles of manufacture, devices and processes taught, and disclosed herein.

Thus, there is provided a downhole plug set in a well in the earth, the plug assembly having: a top cap zone, a middle zone and a bottom cap zone wherein the top cap zone is closer to a top of the well, the middle zone is adjacent to the top cap zone and the bottom zone, and the bottom zone is closer to a bottom of the well; the top zone having a low density material and an alloy, wherein the low density material has a density that is at least 2% lower than a density of the alloy; the middle zone having the alloy; the bottom cap zone having a high density material and an alloy, wherein the high density material has a density that is at least 2% higher than the density of the alloy.

There is further provided a downhole plug set in a well in the earth, the plug assembly having: a top cap zone, a middle zone and a bottom cap zone wherein the top cap zone is closer to a top of the well, the middle zone is adjacent to the top cap zone and the bottom zone, and the bottom zone is closer to a bottom of the well; the top zone consisting essentially of a low density material and an alloy, wherein the low density has of a density that is at least 2% lower than a density of the alloy; the middle zone consisting essentially of the alloy; the bottom cap zone consisting essentially of a high density material and an alloy, wherein the high density material has a density that is at least 2% higher than the density of the alloy.

Additionally, there is provides these plugs, these plug assemblies, and these methods having one or more of the following features: having a heater cavity; wherein the density of the low density material is at least 5% lower than the density of the alloy; wherein the density of the high density material is at least 5% higher than the density of the alloy; wherein the high density material has one or more of Tungsten, Hafnium, Silver, Molybdenum, and alloys thereof; wherein the high density material has one or more of Copper, Nickel, Cobalt, Brass Tungsten, and alloys thereof; wherein the low density material has one or more of Copper, Nickel, Cobalt, Brass Tungsten, and alloys thereof; wherein the low density material has one or more of Steel (mild), Stainless steel, Chromium, Zinc, Zirconium, Germanium, Titanium, Aluminum, and alloys thereof; wherein the allow is a eutectic alloy; wherein the alloy has Bismuth; wherein the high density material has a Brinell Hardness (×107 Pa) in the range of for from about 50 to about 250; wherein high density material has a Brinell Hardness (×107 Pa) that is at least 5× harder than a hardness of the alloy; wherein the high density material has a Brinell Hardness (×107 Pa) that is at least 10× harder than a hardness of the alloy; wherein the high density material has a Brinell Hardness (×107 Pa) that is at least 20× harder than a hardness of the alloy; wherein the high density material has a Brinell Hardness (×107 Pa) that is from 5× to 25× harder than a hardness of the alloy; wherein the low density material has a Brinell Hardness (×107 Pa) in the range of for from about 30 to about 200; wherein the high density material has a Brinell Hardness (×107 Pa) that is at least 5× harder than a hardness of the alloy; wherein the high density material has a Brinell Hardness (×107 Pa) that is at least 10× harder than a hardness of the alloy; wherein the high density material has a Brinell Hardness (×107 Pa) that is at least 15× harder than a hardness of the alloy; wherein the high density material has a Brinell Hardness (×107 Pa) that is from 5× to 20× harder than a hardness of the alloy; wherein the middle zone is in sealing contact with a wall of the well, and exerts a sealing pressure against the wall; wherein the top cap zone is in contact with a wall of the well; wherein the bottom cap zone is in contact with a wall of the well; wherein the middle zone is in uniform contact with a wall of the well, and exerts a sealing pressure against the wall; and, wherein the top cap zone is in uniform contact with a wall of the well and exerts a pressure against the wall; wherein the bottom cap zone is in uniform contact with a wall of the well, and exerts a pressure against the wall;

Moreover, there is provides these plugs, these plug assemblies, and these methods having one or more of the following features: wherein (i) the middle zone is in uniform contact with a wall of the well, and exerts a first sealing pressure against the wall; (ii) wherein the top cap zone is in uniform contact with a wall of the well and exerts a second pressure against the wall; and (iii) wherein the bottom cap zone is in uniform contact with a wall of the well, and exerts a third pressure against the wall; and wherein the first pressure is at least 2× as great as the second pressure, the third pressure or both.

Furthermore, there is provides these plugs, these plug assemblies, and these methods having one or more of the following features: wherein (i) the middle zone is in uniform contact with a wall of the well, and exerts a first sealing pressure against the wall; (ii) wherein the top cap zone is in uniform contact with a wall of the well and exerts a second pressure against the wall; and (iii) wherein the bottom cap zone is in uniform contact with a wall of the well, and exerts a third pressure against the wall; and wherein the first pressure is at least 5× as great as the second pressure, the third pressure or both.

Yet still further, there is provides these plugs, these plug assemblies, and these methods having one or more of the following features: wherein (i) the middle zone is in uniform contact with a wall of the well, and exerts a first sealing pressure against the wall; (ii) wherein the top cap zone is in uniform contact with a wall of the well and exerts a second pressure against the wall; and (iii) wherein the bottom cap zone is in uniform contact with a wall of the well, and exerts a third pressure against the wall; and wherein the first pressure is at least 10× as great as the second pressure, the third pressure or both.

In addition, there is provides these plugs, these plug assemblies, and these methods having one or more of the following features: wherein (i) the middle zone defines a length of the middle zone along an axis of the well; (ii) wherein the top cap zone defines a length of the top cap zone along the axis of the well; and (iii) wherein the bottom cap zone defines a length along the axis of the well; wherein the length of the middle zone is equal to or at least 2× longer than the length of the top cap zone, the bottom cap zone, or both.

Additionally, there is provides these plugs, these plug assemblies, and these methods having one or more of the following features: wherein (i) the middle zone defines a length of the middle zone along an axis of the well; (ii) wherein the top cap zone defines a length of the top cap zone along the axis of the well; and (iii) wherein the bottom cap zone defines a length along the axis of the well; wherein the length of the middle zone is at least 5× longer than the length of the top cap zone, the bottom cap zone, or both.

Additionally, there is provides these plugs, these plug assemblies, and these methods having one or more of the following features: wherein the high density material, the low density material or both have a particle size small than 1000 microns; wherein the high density material, the low density material or both have a particle size small than 50 microns; wherein the high density material, the low density material or both have a particle size small than 10 microns; wherein the high density material, the low density material or both have a particle size in the range of about 0.05 microns to about 50 microns; wherein the high density material, the low density material or both are located at the grain boundaries of the alloy.

Moreover, there is provided a plug assembly for plugging a well in the earth, the plug assembly having: a plugging material; the plugging material having a mixture of an alloy have a density, a hardness and a melting point, and a first hard material having a density, a hardness and a melting point; wherein the mixture contains separate particles of the alloy and the first hard material. wherein the density of the alloy is at least 2% different from the density of the first hard material, the melting point of the alloy is at least is at least 4× lower than the melting point of the hard material, and the first hard material has a hardness that is at least 2× greater than the hardness of the alloy.

Moreover, there is provided a plug assembly for plugging a well in the earth, the plug assembly having: a plugging material; the plugging material consisting essentially of a mixture of an alloy having a density, a hardness and a melting point, and a hard material having a density, a hardness and a melting point; wherein the mixture contains separate particles of the alloy and the hard material. wherein the density of the alloy is at least 2% different from the density of the hard material, the melting point of the alloy is at least is at least 4× lower than the melting point of the hard material, and the hard material has a hardness that is at least 2× greater than the hardness of the alloy.

Additionally, there is provides these plugs, these plug assemblies, and these methods having one or more of the following features: wherein the plug assembly has a heater cavity; wherein the plug assembly has a heater cavity, wherein the plugging material is in contact with an outer wall of the heater cavity, and thereby in thermal contact with the heater cavity, and located around the outer wall; wherein the plug assembly has a heater cavity, wherein the plugging material is in contact with an outer wall of the heater cavity, and thereby in thermal contact with the heater cavity, and located around the outer wall; and having a heater in the heater cavity; wherein the plug assembly has a heater cavity, wherein the plugging material is in contact with an outer wall of the heater cavity, and thereby in thermal contact with the heater cavity, and located around the outer wall; and having a chemical heater in the heater cavity; wherein the plug assembly has a heater cavity, wherein the plugging material is in contact with an outer wall of the heater cavity, and thereby in thermal contact with the heater cavity, and located around the outer wall; and having a chemical heater in the heater cavity, wherein the chemical heater has thermite.

Moreover, there is provides these plugs, these plug assemblies, and these methods having one or more of the following features: wherein the density of the alloy is at least 5% different from the density of the first hard material; wherein the melting point of the alloy is at least is at least 5× lower than the melting point of the first hard material; wherein the first hard material has a hardness that is at least 5× greater than the hardness of the alloy.

Additionally, there is provides these plugs, these plug assemblies, and these methods having one or more of the following features: wherein the mixture further having: a second hard material hard having a density, a hardness and a melting point; wherein the density of the alloy is at least 2% different from the density of the second hard material, the melting point of the alloy is at least is at least 4× lower than the melting point of the second hard material, and the second hard material has a hardness that is at least 2× greater than the hardness of the alloy; and, wherein the density of the first hard material is not the same as the density of the second hard material, and the density of the first hard material is higher than the density of the second hard material; whereby the first hard material defines a high density material of the mixture and the second material defines a low density material of the matrix.

Moreover, there is provided a plug assembly for plugging a well in the earth, the plug assembly having: a plugging material; the plugging material consisting essentially of a mixture of an alloy having a density, a hardness and a melting point, and a first hard material having a density, a hardness and a melting point and a second hard material having a density, a hardness and a melting point; wherein the mixture contains separate particles of the alloy and the first and second hard materials; wherein the density of the alloy is at least 2% different from the density of the first hard material, the melting point of the alloy is at least is at least 4× lower than the melting point of the first hard material, and the first hard material has a hardness that is at least 2× greater than the hardness of the alloy; and wherein the density of the alloy is at least 2% different from the density of the second hard material, the melting point of the alloy is at least is at least 4× lower than the melting point of the second hard material, and the second hard material has a hardness that is at least 2× greater than the hardness of the alloy; and, wherein the density of the first hard material is not the same as the density of the second hard material, and the density of the first hard material is higher than the density of the second hard material; whereby the first hard material defines a high density material of the mixture and the second material defines a low density material of the matrix.

Moreover, there is provides these plugs, these plug assemblies, and these methods having one or more of the following features: wherein the density of the low density material is at least 5% lower than the density of the alloy; wherein the density of the high density material is at least 5% higher than the density of the alloy; wherein the high density material has one or more of Tungsten, Hafnium, Silver, Molybdenum, and alloys thereof; wherein the high density material has one or more of Copper, Nickel, Cobalt, Brass Tungsten, and alloys thereof; wherein the low density material has one or more of Copper, Nickel, Cobalt, Brass Tungsten, and alloys thereof; wherein the low density material has one or more of Steel (mild), Stainless steel, Chromium, Zinc, Zirconium, Germanium, Titanium, Aluminum, and alloys thereof; wherein the allow is a eutectic alloy; wherein the alloy has Bismuth; high density material has a Brinell Hardness (×107 Pa) in the range of for from about 50 to about 250; high density material has a Brinell Hardness (×107 Pa) that is at least 5× harder than a hardness of the alloy; high density material has a Brinell Hardness (×107 Pa) that is at least 10× harder than a hardness of the alloy; high density material has a Brinell Hardness (×107 Pa) that is at least 20× harder than a hardness of the alloy; high density material has a Brinell Hardness (×107 Pa) that is from 5× to 25× harder than a hardness of the alloy; low density material has a Brinell Hardness (×107 Pa) in the range of for from about 30 to about 200; high density material has a Brinell Hardness (×107 Pa) that is at least 5× harder than a hardness of the alloy; high density material has a Brinell Hardness (×107 Pa) that is at least 10× harder than a hardness of the alloy; high density material has a Brinell Hardness (×107 Pa) that is at least 15× harder than a hardness of the alloy; and high density material has a Brinell Hardness (×107 Pa) that is from 5× to 20× harder than a hardness of the alloy;

Moreover, there is provides these plugs, these plug assemblies, and these methods having one or more of the following features: wherein the plug assembly is placed within a well, the heater is activate softening, melting or both and causing the alloy in the mixture to flow, the hard materials migrating in the soften, molten or both, alloy to an end of the plug; wherein bottom and top zones of the plug are solidified first and there by constrain the alloy's expansion upon cooling, providing greater lateral sealing force against the wall of the well; wherein the plug is positioned in a vertical section of the well.

DESCRIPTION OF THE PREFERRED EMBODIMENTS

Figure 1A:
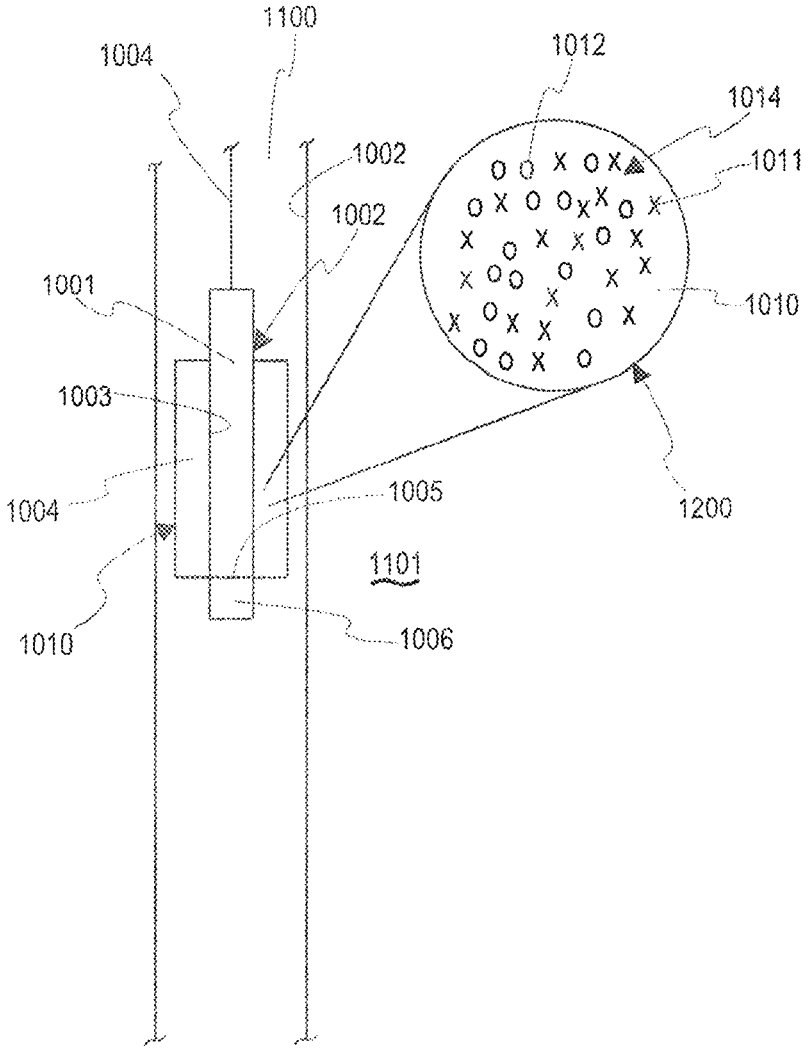
FIG. 1A is a schematic of an embodiment of a plug assembly positioned but not set in a well, in accordance with the present inventions.

Embodiments of the present inventions relate to allow based down hole tools, plugging and abandonment activities and workover activities in boreholes, including hydrocarbon wells and geothermal wells.

U.S. Pat. No. 10,309,187 discloses a down hole tools and methods, the entire disclosure of which is incorporated herein by reference.

In embodiments as the plug is cast in a wellbore, the ends of the plug solidify first; these solid ends serve as structural members (like bulkheads) that constrain the still-solidifying (and thus still-expanding) alloy between either end. The strength of the ends of the plug is thus in embodiments related to trapping the expansion in the middle of the plug. Further, as it is expansion that generates contact pressure, which in turn provides sealing ability, the pressure which the plug is capable of sealing against is thus influenced by the strength of the ends of the plug, among other things.

In an embodiment a means to reinforce the ends of a plug to increase their strength, while forming the middle section of mostly bismuth alloy to provide expansion and sealing, is provided. In a preferred embodiment the middle of the plug is mostly alloy (e.g., greater than 60%, greater than 70%, greater than 80%, greater than 90%, greater than 95%, 100%) to provide enough expansion and sealing, as the reinforcing material in the ends, preferably will not melt, and thus neither expand or contract.

An embodiment of the present invention is a plug with composite reinforced end(s) and a mostly-bismuth-alloy middle section. At least one end comprises a composite material, or both ends comprise composite materials. The end(s) are composite material(s), the matrix material being the base bismuth alloy itself, and the filler material(s) being stronger material(s) than the bismuth alloy.

In the preferred embodiment, there are two end filler materials; one has a lower density than that of the density of the molten base alloy, and one has a higher density. When the alloy is melted downhole, the lower-density filler material will float in the molten alloy, rising to the top of the alloy pool. Due to their buoyancy, the lower-density material pieces or particles will distribute themselves more-or-less uniformly, approaching the maximum volumetric packing density of the filler particles. As the alloy later solidifies the particles will be frozen or embedded in this state, forming a top "bulkhead" section at the top of the plug. Likewise, the higher-density material will sink in the molten alloy, and once the alloy has solidified will form a similar bulkhead at the bottom end of the plug.

In this embodiment, the filler materials rise and sink quickly enough in the molten alloy to reach their desired end locations before the plug solidifies. To achieve this, the top filler material must be at least 2% less-dense, and the bottom filler material must be at least 2% more-dense, than the molten alloy itself. In the preferred embodiment, the top filler material should be at least 5% less-dense, and the bottom filler material should be at least 5% more-dense, than the molten alloy itself. Additionally, the filler materials are stronger, and preferably substantially stronger, than the solidified alloy; minimally, 1.5×, 2×, 2.5×, 3× and as strong. Further, the filler materials must have a melting point substantially higher than that of the alloy itself, as it is not intended that the filler materials melt into the alloy, but rather remain whole and embedded in the alloy.

"Alloy", in this context, may include any metal that comprises bismuth, including essentially pure bismuth. Preferably, the alloy comprises bismuth plus at least one additional alloying element. Alloying elements may include, but are not limited to, tin, lead, silver, copper, antimony, nickel, and germanium. A common alloy comprises nominally 58% bismuth and 42% tin (by weight). The specific gravity of pure molten bismuth is about 10.07. The specific gravity of the various alloys used will generally fall in the range of about 8.0 to 10.5, although some alloying elements could broaden the range to about 4.0 to 11.0.

A common alloy has a specific gravity of about 8.7 in the molten state. For this alloy, then, a top end filler material must thus have a specific gravity of no more than 8.5, and preferably a specific gravity of about 8.3 or less; likewise, a lower end filler material must have a specific gravity of at least 8.9, and preferably about 9.1 or greater. An exemplary top filler is 316 stainless steel, which has a specific gravity of about 8.0. An exemplary bottom filler is a tungsten-copper alloy, which may be tailored for this application to have a specific gravity in the range of about 9.4 to 19.0.

Depending on the particular base alloy used, and on other considerations such as the corrosivity of the fluid in the wellbore and the life expectancy required of the plug, alternative top end filler materials could include materials such as iron, aluminum, titanium, or their alloys, or non-metals such as ceramics. Bottom-end filler materials may include copper, tungsten, or a few other high-density metals, either as pure elements, alloyed materials, or composite materials made by a process such as sintering. Tungsten-copper, tungsten-iron, tungsten-cobalt, or tungsten-nickel are examples of such sintered materials. Among high-density elements, tungsten in particular is attractive due to low radioactivity.

In addition to their specific gravity, other considerations for filler materials may be their corrosion resistance and shape. The abovementioned filler materials are relatively corrosion resistant (as compared, for example, to steel alloys).

One convenient shape for the end filler materials may be "shot", i.e., spherical material made through a molten drop process or a casting process. Shot is likely to form a composite bulkhead with the highest volumetric packing density. Alternatively, the materials may be random shapes made by crushing brittle materials. Alternatively again, the end filler materials may be shards or fibers with a high length-to-thickness ratio, so that they mesh and interlock, thereby creating greater resistance to movement and thus higher strength.

The alloy and filler material may be deployed into the wellbore by providing a tool comprising casting alloy and filler material around a heater containing chemical means such as thermite, or electrical heating elements. The alloy and filler material(s) may alternatively be deployed into the wellbore by casting around a tubular member which surrounds a heater. The exact arrangement of the particles that are cast onto the heater is not critical, as once the alloy is melted the particles will re-distribute themselves in the molten alloy as a function of their individual densities relative to that of the molten alloy, the less-dense particles rising and more-dense heavier particles sinking.

Alternatively, one or more of the alloy and filler materials may be deployed as individual particles (e.g., shot) which are dropped around a heater. One method of dropping the particles may be to fill a hollow member known in the industry as a dump bailer with the particles, deploy the dump bailer into the wellbore, then open the dump bailer to dump the particles around the heater. Another method may be to simply dump the particles down the wellbore to let them settle around the heater.

In the preferred embodiment, the thickness of the end bulkheads is about 15% of the overall length of the plug. However, this thickness may range from about 2% to about 30%.

Figure 1B:
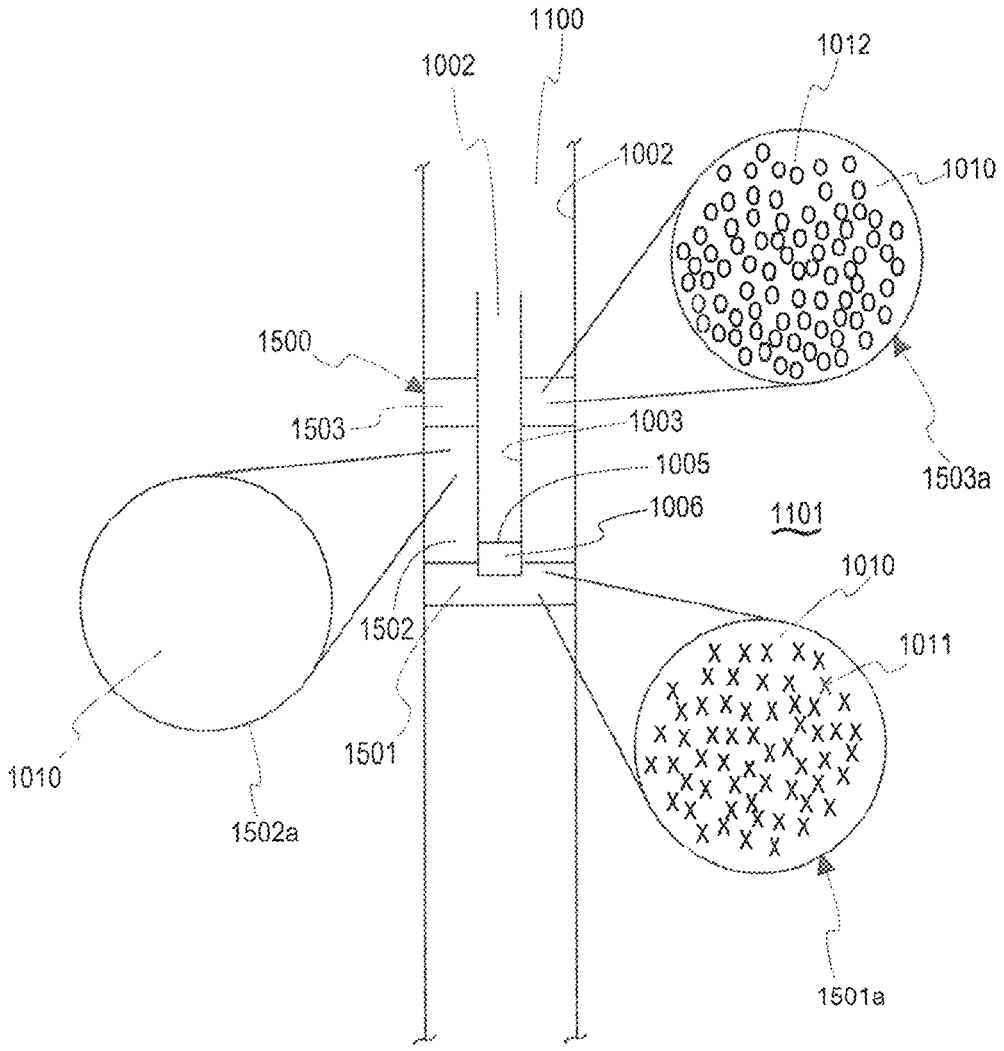
FIG. 1B is a schematic of the embodiment of FIG. 1A set as a plug in a well in accordance with the present inventions.

Turning to FIG. 1A and FIG. 1B there is shown a cross sectional schematic of an embodiment generally depicting the present plug assemblies and set plugs. FIG. 1A shows the plug assembly 1000 in a well 1100 in the earth 1101. The well 1000 having a side wall 1002. The side wall 1002 may be a casing or it may be the earth, e.g., open hole, it may also be a gravel screen or other know type of well side wall. The plug assembly 1000 has a heater 1001 in a heater cavity 1002, formed by an inner wall 1003. The heater 1001 can be a chemical heater, such as using thermite, an electric heater, or other heaters known to the art. The plug assembly 1000 is positioned in the well 1100 by wire line 1004, or other type of deployment device, and has a line for controlling the heating of the heater (e.g., the ignition of the heater) The heater cavity having a solid bottom 1006 connected to the inner wall 1003. Around the exterior of the inner heater wall 1003 is the plugging material 1004. The plug assembly 1000 also may have a cooling section 1006, or other means to slow and control the flow of the plugging material 1004 when it is molten. The plugging material 1004 is a mixture of a low melting point material 1010 that expands upon cooling (e.g., an alloy, a eutectic material, a bismuth containing material, etc.) and one, two, three or more other materials having different physical properties from the low melting point material 1010. In this embodiment the other materials are high melting point materials, that are substantially harder than the material 1010. The first material 1011 shown by a "x" is a high density material, having a density higher than the material 1010. The second material 1012 shown by an "o" is a low density material, having a density lower than the material 1010. The call-out circle 1200 shows an enlarged schematic view of the plugging material 1004 in the pre-plug configuration. In this pre-plug configuration the low melting point expandable material 1010, the first material 1011 and the second material 1012 are distributed amongst themselves. They can be randomly distributed, or evenly distributed, as well as other distributions.

Turning to FIG. 1B, the heater 1001 in the plug assembly 1100 has been activated, melting the material 1010 in the plugging material 1004 and causing the material to flow down and cool, forming a set plug 1500 in well 1100 (e.g., the plug configuration). In FIG. 1B the heater has been removed from the heater cavity 1002.

The plug 1500 in the plug configuration has three zones that are formed as a result of the different densities and melting points of the materials making up the plugging material 1004. (The plugging material is preferably a true mixture, with the two or more different materials not being allowed, chemically reacted or dissolved in the others.)

Zone 1503 (shown schematically in detail circle 1503*a*) contains the lower density material 1012 and a sufficient amount of material 1010 to bind the lower density material 1012. Thus, zone 1503 is a top cap to the plug 1500.

Zone 1502 (shown schematically in detail circle 1502*a*) contains material 1010 (and preferably none of the first material 1011 and none of the second material 1012, although small or in some embodiments larger amounts of the first, the second or both can be present). Zone 1502 is the middle zone and would typically provide greater pressure, and in embodiments significantly greater pleasure, against the side wall 1002, than either zone 1503 or zone 1501. Thus zone 1502, the middle zone, can also be viewed as the primary sealing zone. Zone 1502 also has a considerably longer length and thus fills a large portion of the well than either zones 1501 or 1503, alone or in combination.

Zone 1501 (shown schematically in detail circle 1501*a*) contains the lower density material 1011 and a sufficient amount of material 1010 to bind the lower density material 1011. Thus, zone 1501 is a bottom cap to the plug 1500.

Zone 1502 seals the well to prevent hydrocarbons or gasses from escaping from the well. Preferably, zones 1503 and 1501 also seal the well preventing hydrocarbons or gasses from escaping from the well.

The plugging material 1004 can be made up of one or more a high density material (which forms a bottom cap when the plug is set), a low density material (which forms a top cap when the plug is set) and a eutectic alloy which metals, flows and expands upon cooling forming the plug, i.e., the set plug in the well.

Generally, the various embodiments of the present plug assemblies and plugs, including the Examples, can use the materials of Table 1 to form the plugging material, and then upon setting the two or more zones of the plug.

TABLE 1

| Zone | Metal/Material | Density, g/cm^3 | Melting, C. | Hardness Brinell (×10^7 Pa) |
|---|---|---|---|---|
| Bottom cap | Tungsten | 19.25 | 3,400 | 196-245 |
| Bottom cap | Hafnium | 13.31 | 2233 | 145-210 |
| Bottom cap | Silver | 10.49 | 961 | 20.6 |
| Bottom cap | Molybdenum | 10.22 | 2620 | 134 |
| Bottom/Top cap depending on allow density | Copper | 8.93 | 1,084 | 52 |
| Bottom/Top cap depending on allow density | Nickel | 8.9 | 1453 | 90-120 |
| Bottom/Top cap depending on allow density | Cobalt | 8.83 | 1,495 | 129 |
| Bottom/Top cap depending on allow density | Brass | 8.5-8.8 | 930 | 50 |
| Top cap | Steel (mild) | 7.85 | 1390-1425 | 120-150 |
| Top cap | Stainless steel | 7.7-8 | 1375-1530 | 200 |
| Top cap | Chromium | 7.19 | 1860 | 69 |
| Top cap | Zinc | 7.13 | 420 | 48-52 |
| Top cap | Zirconium | 6.51 | 1855 | 33 |
| Top cap | Germanium | 5.32 | 938 | |
| Top cap | Titanium | 4.51 | 1670 | 103 |
| Top cap | Aluminum | 2.7 | 660 | 18.4 |
| Middle zone | Alloys | ~8-10 | ~130-270 | ~10-20 |

Top cap material is preferably at least 2% less-dense and more preferably 5% less dense than the molten alloy itself. Bottom cap material is preferably at least 2% more dense and more preferably at least 5% more dense than the molten alloy itself.

It is understood that the heater can be reinserted into the heater cavity of a set plug, melt the plug and remove it from the well.

The following examples are provided to illustrate various embodiments of the present plugging assemblies, plugs and plugging materials, systems and operations. These examples are for illustrative purposes, may be prophetic, and should not be viewed as, and do not otherwise limit the scope of the present inventions.

Example 1

There is cast a bismuth-lead-tin alloy, steel shot, and tungsten-copper shot in an acrylic tube of about 4" diameter. The steel shot rose to the top and the tungsten-copper shot sunk to the bottom of the alloy, which then solidified, freezing the shot in place. This slug was then cut up to verify that the shot had indeed migrated as desired, forming bulkheads at either end, and that there was essentially no shot in the middle of the plug.

Example 2

A bismuth-tin alloy, steel shot, and tungsten-copper shot were poured into a steel tube of about 3.5" diameter (see image below). It was clear that shot sank to the bottom and rose to the top.

Example 3

The composite ends of the plug are at least 0.5 feet in length, at least 1 foot in length, at least 2 feet in length, at least 3 feet in length, from 0.2 feet to 3 feet, from 0.5 feet to 2 feet, about 0.5 fee, about 1 foot, about 1.5 feet, about 2 feet and about 2.5 feet and longer and shorter lengths. The lengths of the ends can be the same or different.

Example 4

The middle section of the plug, has an eutectic alloy, bismuth, gallium, antimony and combinations and variations of these, without the strength material found in the composite ends. The middle section can have a length that is from about 1 foot to about 20 feet, greater than about 2 feet, greater than about 5 feet, greater than about 20 feet, from about 10 feet to about 50 feet, and greater and smaller lengths Example 5

The middle section of the tool, makes up from about 50% to about 80% of the total length of the tool, at least about 60%, at least about 70%, at least about 80% and at least about 90% of the length of the tool.

Example 6

The end section or sections, having the composite material, defining a total length of the end section that is less than 30% of the total length of the tool, less than 25% of the total length, less than about 20% of the total length, and less than 15% of the total length of the tool.

Example 7

The Bi-based alloys are used in well plugging applications at temperatures above half its melting point where they may exhibit creep. The embodiment hardens the alloys by introducing powders of high-melting metals such as molybdenum, tungsten, Ni and Fe—Ni—Cr—Cu—W—Mo alloys (stainless steel). These added materials have very limited solubility/alloying ability with the "alloy", i.e., the eutectic alloy, including Bismuth. When deployed and melted to form a plug downhole, they remain dispersed to provide strength and creep resistance after solidification.

Example 8

The density of the materials used for the top cap zone and the bottom cap zone, e.g., the particles can also be adjusted down (lower density) by creating an outside oxide layer which is less dense. The oxide layer being more chemically inert will also play a role of a protective layer.

Example 9

A plug having a matric of one, two, three or more materials having different physical properties but having closer densities, e.g., within 2% or less, can be formed. Additionally, if the particle size of the particles of these materials is small enough, that creating a greater likelihood of them being suspended in the molten allow materials having larger differences in density can be used.

Example 10

The bottom cap material, the top cap material and both of Table 1, or others, has a particle size of from about 0.050 microns to 50 microns, about 0.1 micron to about 30 microns, about 1 micron to about 25 microns, greater than 0.01 microns, greater than 0.1 microns, greater than 1 micron, greater than 2 microns.

Example 11

The bottom cap material, the top cap material and both of Table 1 can have particle sizes of from about 50 microns to about 1,200 microns, about 100 microns to about 1,000 microns, about 500 microns to about 1000 microns, less than 1,500 microns, and less than 1000 microns.

Example 12

Figure 2:
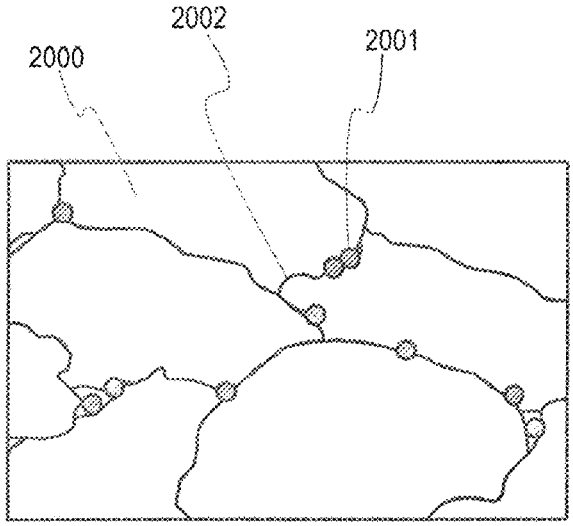
FIG. 2 is a schematic of an embodiment of a matrix of the material in a set plug in accordance with the present inventions.

The plugging material as described above can be configured to provide one zone (i.e., the entire plug), two zones or three zones, where the materials added to the alloy, are particles, e.g., having the size of less than 50 microns, and are distributed at the grain bounders of the solidified alloy as depicted in FIG. 2. In this embodiment, the set plug will have a matrix of alloy 2000, and the top cap or bottom cap material e.g., 2001 are distributed along grain boundaries, e.g., 2002, as shown in FIG. 2.

Example 13

Figure 3:
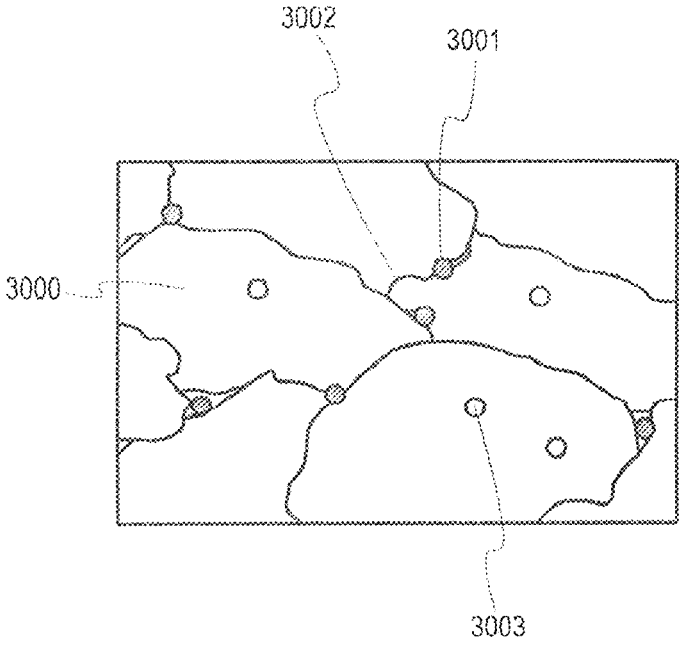
FIG. 3 is a schematic of an embodiment of a matrix of the material in a set plug in accordance with the present inventions.

Turning to FIG. 3, the step plug has a matrix of allow 3000, with one material e.g., 3001 being located along the grain boundaries, e.g., 3002, and a second material 3003 located within the alloy 3000.

Example 14

Any and all combinations and variations of the embodiments of the tools, plug assemblies and plugging materials of Examples 1 to 13.

It should be understood that the use of headings in this specification is for the purpose of clarity, and is not limiting in any way. Thus, the processes and disclosures described under a heading should be read in context with the entirely of this specification, including the various examples. The use of headings in this specification should not limit the scope of protection afforded the present inventions.

It is noted that there is no requirement to provide or address the theory underlying the novel and groundbreaking processes, materials, performance or other beneficial features and properties that are the subject of, or associated with, embodiments of the present inventions. Nevertheless, various theories are provided in this specification to further advance the art in this area. The theories put forth in this specification, and unless expressly stated otherwise, in no way limit, restrict or narrow the scope of protection to be afforded the claimed inventions. These theories many not be required or practiced to utilize the present inventions. It is further understood that the present inventions may lead to new, and heretofore unknown theories to explain the function-features of embodiments of the methods, articles, materials, devices and system of the present inventions; and such later developed theories shall not limit the scope of protection afforded the present inventions.

The various embodiments of systems, equipment, techniques, methods, activities and operations set forth in this specification may be used for various other activities and in other fields in addition to those set forth herein. Additionally, these embodiments, for example, may be used with: other equipment or activities that may be developed in the future; and with existing equipment or activities which may be modified, in-part, based on the teachings of this specification. Further, the various embodiments set forth in this specification may be used with each other in different and various combinations. Thus, for example, the configurations provided in the various embodiments of this specification may be used with each other. For example, the components of an embodiment having A, A' and B and the components of an embodiment having A", C and D can be used with each other in various combination, e.g., A, C, D, and A. A" C and D, etc., in accordance with the teaching of this Specification. The scope of protection afforded the present inventions should not be limited to a particular embodiment, configuration or arrangement that is set forth in a particular embodiment, example, or in an embodiment in a particular Figure.

The invention may be embodied in other forms than those specifically disclosed herein without departing from its spirit or essential characteristics. The described embodiments are to be considered in all respects only as illustrative and not restrictive.

What is claimed:

1. A downhole plug for a well in the earth, the plug comprising:

a eutectic and/or bismuth based alloy that expands upon cooling, said alloy having a density;

a low density material that has a density that is at least 2% lower than the alloy density;

a high density material that has a density that is at least 2% higher than the alloy density;

a top cap zone that is closer to a top of the well and comprises the low density material and the alloy;

a bottom cap zone that is closer to a bottom of the well and comprises the high density material and the alloy;

a middle zone that is adjacent to the top cap zone and the bottom cap zone and comprises the alloy; and wherein the high density material and/or the low density material having a particle size smaller than 1000 microns.

2. The plug as defined in claim 1 wherein the high density material and/or the low density material having a particle size smaller than 50 microns; wherein further preferably said particle size is smaller than 10 microns; and wherein most preferably said particle size is in the range of about 0.05 microns to about 50 microns.

3. A method of setting a downhole plug of claim 1, the method consisting of:

deploying said plug into the well;

melting the alloy with a heater; and allowing the alloy to cool and re-solidify in the well.

4. The method as defined in claim 3 further including casting the plug around said heater.

5. The method as defined in claim 3 further including deploying said plug as individual particles and dropping said particles around the heater.

6. The plug as defined in claim 1 wherein the density of the low density material is at least 5% lower than the density of the alloy; and/or the density of the high density material is at least 5% higher than the density of the alloy.

7. The plug as defined in claim 1 wherein the high density material comprises one or more of Tungsten, Hafnium, Silver, Molybdenum, Copper, Nickel, Cobalt, Brass Tungsten, and alloys thereof.

8. The plug as defined in claim 1 wherein the low density material comprises one or more of Copper, Nickel, Cobalt, Brass Tungsten, Mild Steel, Stainless Steel, Chromium, Zinc, Zirconium, Germanium, Titanium, Aluminum, and alloys thereof.

9. The plug as defined in claim 1 wherein the high density material has a Brinell Hardness in the range of from about 60 to about 250.

10. The plug as defined in claim 1 wherein the high density material has a Brinell Hardness that is at least 5× harder than a hardness of the alloy; wherein preferably the high density material has a Brinell Hardness that is at least 10× harder than a hardness of the alloy; wherein further preferably the high density material has a Brinell Hardness that is at least 20× harder than a hardness of the alloy;

and wherein most preferably the high density material has a Brinell Hardness that is from 5× to 25× harder than a hardness of the alloy.

11. The plug as defined in claim 1 wherein the low density material has a Brinell Hardness in the range of from about 30 to about 200.

12. The plug as defined in claim 1, wherein:

said middle zone defines a length of the middle zone along an axis of the well;

said top cap zone defines a length of the top cap zone along the axis of the well;

said bottom cap zone defines a length along the axis of the well; and said length of the middle zone is equal to or at least 2× longer, and preferably 5× longer, than the length of the top cap zone, the bottom cap zone, or both.

13. A plug assembly for plugging a well in the earth, the plug assembly having a plugging material that comprises:

a eutectic and/or bismuth based alloy that expands upon cooling;

a low density material that has a density that is at least 2% lower than the alloy;

a high density material that has a density that is at least 2% higher than the alloy;

wherein said plugging assembly has a heater within a heater cavity and the plugging material is in contact with an outer wall of the heater cavity, and thereby in thermal contact with the heater cavity, and located around the outer wall; and said high density material and/or the low density material has a particle size smaller than 1000 microns.

14. The plug assembly as defined in claim 13 wherein:

said alloy has a melting point that is at least 4× lower than the low density material and the high density material; and said low density material and said high density material both have a hardness that is at least 2× greater than the alloy.

* * * * *